United States Patent [19]

Frayer et al.

[11] 4,179,355

[45] Dec. 18, 1979

[54] COMBINATION RESIDUAL OIL HYDRODESULFURIZATION AND THERMAL CRACKING PROCESS

[75] Inventors: James A. Frayer, Pittsburgh; Harry C. Stauffer, Cheswick; Francis E. Wynne, Jr., Allison Park; Stephen J. Yanik, Valencia, all of Pa.

[73] Assignee: Gulf Research and Development Company, Pittsburgh, Pa.

[21] Appl. No.: 843,880

[22] Filed: Oct. 20, 1977

[51] Int. Cl.[2] ..... C10G 23/02

[52] U.S. Cl. ..... 208/89; 208/210

[58] Field of Search ..... 208/89, 210

[56] References Cited

U.S. PATENT DOCUMENTS 3,663,434 5/1972 Bridge ..... 208/210

*Primary Examiner*—George Crasanakis

[57] ABSTRACT

Residual oils which are thermally cracked with entrained hot solids in a low residence time riser must be hydrodesulfurized so that sulfur oxide emissions in the flue gas of the solids regenerator are maintained within environmentally acceptable limits. Of a full range residual oil thermal cracking feedstock, the lower boiling distillate feed components are capable of providing a higher ethylene yield with a lower dispersant steam requirement as compared to the high boiling residual feed components. In accordance with the present invention, the high boiling residual components of a thermal cracker feed residual oil are selectively removed during hydrodesulfurization to provide a non-aliquot distillate-residual oil hydrodesulfurization product in which the ratio of lower boiling distillate oil to high boiling residual oil is enhanced. Modifying the aliquot distribution of distillate and residual components in this manner provides an interdependent effect in the combination process since the distillate-enriched cracking feedstock not only provides both an improved ethylene yield and a greater steam economy in the thermal cracking operation but it also reduces hydrogen consumption in the hydrodesulfurization operation. Further interdependence between the hydrodesulfurization and thermal cracking operations is obtained by utilizing the residual oil which is selectively removed during the hydrodesulfurization step as fuel in the solids regenerator of the cracking unit, thereby making the more valuable, highly aromatic black oil produced in the thermal cracking process available for conversion to needle coke and carbon black.

16 Claims, 4 Drawing Figures

Figure 1:
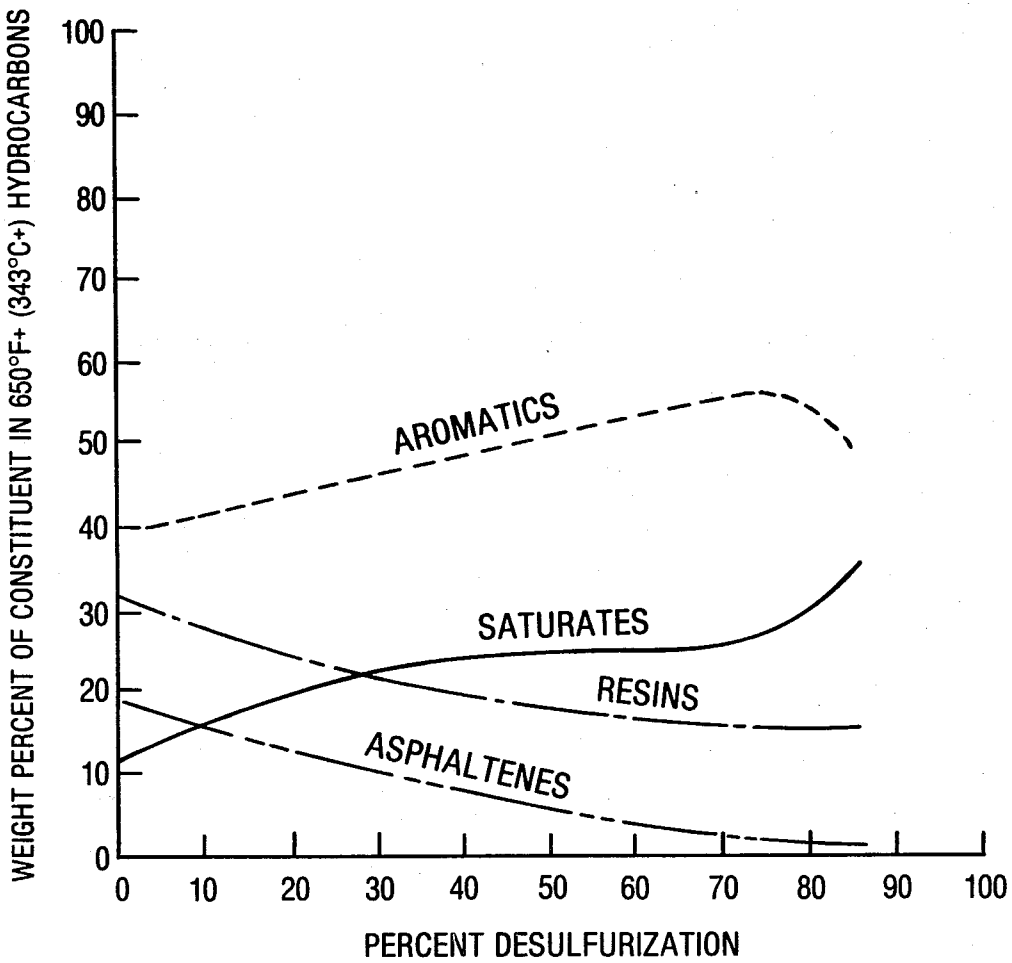

FEED OIL
110
H2
114
FIRST HDS STAGE
112
116
FLASH
118
120
122
124
REFINERY FUEL
126
130
FUEL OIL
141
143
140
PREHEAT
145
FLASH
138
139
134
SECOND HDS STAGE
128
H2
132
STEAM
142
147
THERMAL CRACKER
149
144
AIR
154
152
SOLIDS REGENERATOR
158
FLUE GAS
156
SOLIDS SEPARATOR
150
146
ETHYLENE
148

COMBINATION RESIDUAL OIL HYDRODESULFURIZATION AND THERMAL CRACKING PROCESS

This invention relates to a process for the hydrodesulfurization and thermal cracking with inert hot solids as a heat source of residual oils containing metals, sulfur and asphaltenes.

The hydrodesulfurization operation employed is highly interdependent with respect to the thermal cracking operation. The hydrodesulfurization operation is performed in a manner which increases the aliquot ratio of distillate to residual components in the residual oil, thereby improving hydrogen economy in the hydrodesulfurization operation and increasing ethylene yield and reducing dispersant steam requirements in the thermal cracking operation.

When residual oils, such as petroleum residuals, are desulfurized in the presence of molecular hydrogen, the hydrogen consumption economy of the desulfurization reaction decreases as the depth of sulfur removal increases. For example, in the catalytic hydrodesulfurization of a 650° F.+(343° C.+) Kuwait reduced crude oil containing 4 weight percent sulfur, it was found that removal of 3 of the 4 weight percent sulfur present in the oil to reduce the sulfur content of the oil to 1 weight percent requires a hydrogen consumption of about 500 standard cubic feet per barrel (9 SCM/100 L), providing a hydrogen efficiency of 167 standard cubic feet of hydrogen (4.68 $M^3$) per percent of sulfur in the oil which is removed. The removal of the next 0.7 weight percent increment to reduce the sulfur content of the oil to 0.3 weight percent requires a hydrogen consumption of 165 standard cubic feet per barrel (2.96 SCM/100 L), providing a hydrogen efficiency of 236 standard cubic feet of hydrogen (6.61 $M^3$) per percent of sulfur in the oil which is removed. Finally, the removal of an additional 0.2 weight percent sulfur increment to reduce the sulfur content of the oil to 0.1 weight percent requires a hydrogen consumption of 170 standard cubic feet per barrel (3.07 SCM/100 L), providing a hydrogen efficiency of 850 standard cubic feet of hydrogen (23.8 $M^3$) per percent of sulfur in the oil which is removed. These data show that with removal of progressively deeper increments of sulfur from the residual oil the hydrodesulfurization process becomes progressively hydrogen inefficient as evidenced by the fact that removal of the final 0.2 weight percent increment of sulfur in the oil requires about 5 times the hydrogen consumption per atom of sulfur removed as compared to the hydrogen consumption during the removal of the first 3 weight percent increment of sulfur in the oil.

The present process employs a method for the multistage desulfurization of residual oil which provides a desulfurized product having a relatively low sulfur level while avoiding deep, hydrogen-inefficient hydrodesulfurization of the heavy portion of the oil. The present process employs a series multi-stage hydrodesulfurization operation including removal of a portion of a concentrated high boiling residual stream between upstream and downstream stages. At the same time, a concentrated distillate fraction is charged to the downstream stage independently of the residual fraction. Thereby, the stream entering the downstream stage contains a non-aliquot proportion of distillate and residual components since it is impoverished or depleted of residual components although it can contain most or all of the distillate components of the feed oil to the hydrodesulfurization process. Since the sulfur in the distillate oil is relatively non-refractory, the dilution of residual components with distillate oil relieves the downstream stage of the necessity of accomplishing extremely deep desulfurization of refractory residual components in order to produce a low sulfur effluent stream.

One method of obtaining a non-aliquot distillate-residual oil which is relatively enriched in distillate components is to distill a crude or reduced crude feed oil containing substantially all of the asphaltenes of the full crude to prepare separate distillate and residual oil fractions for hydrodesulfurization. According to this method, the residual fraction is passed to a first or upstream hydrodesulfurization stage while the distillate fraction bypasses the upstream stage and is passed directly to a second or downstream stage. A portion of the residual oil fraction is removed between the stages, and the greater the amount of distillate oil removed at the feed distillation column the more concentrated in residual components will be the oil removed between the stages and the greater will be the dilution of the non-removed residual components when blended with the distillate fraction in the downstream stage. An amount ranging between about 10, 20 or 30 up to 50, 65 or 75 weight percent of the essentially full range normally liquid material in the stream flowing between the stages is removed from the process.

Another method for increasing the aliquot ratio of distillate to residual components of the oil during the hydrodesulfurization operation provides the advantage of a diminished distillation energy consumption by utilizing the exothermic heat of the hydrodesulfurization reaction in the first or upstream stage to accomplish at least part of the separation of distillate from residual oil. According to this method, the hot effluent from the first hydrodesulfurization stage is passed to a separation chamber to flash a distillate fraction from residual material. For example, the chamber can conveniently produce a 375° to 650° F. (191° to 343° C.) overhead distillate fraction using the exothermic heat generated in the first hydrodesulfurization stage. The amount of distillate produced at the interstage flash can be increased by adding heat to the interstage flash chamber which is obtained from a source other than the upstream hydrodesulfurization stage. In this manner, a distillate fraction of any suitable boiling range can be taken overhead from the interstage flashing step. A segment of the flash residue is removed from the process and the interstage distillate fraction is passed to the second or downstream stage together with the remaining portion of the flash residue. An amount ranging between about 10, 20 or 30 up to 50, 65 or 75 weight percent of the flash residue is removed from the process. In this manner, the exothermic heat of the first stage hydrodesulfurization reaction is utilized to at least partially separate distillate from residual components so that a portion of the concentrated residual oil stream can be removed from the process and a non-aliquot distillate-residual oil second stage stream can be prepared which is relatively enriched in distillate components. If desired, the second stage stream can be further enriched in distillate components by the addition thereto of an extraneous distillate stream.

The present invention is illustrated in the accompanying figures in which

Figure 2:
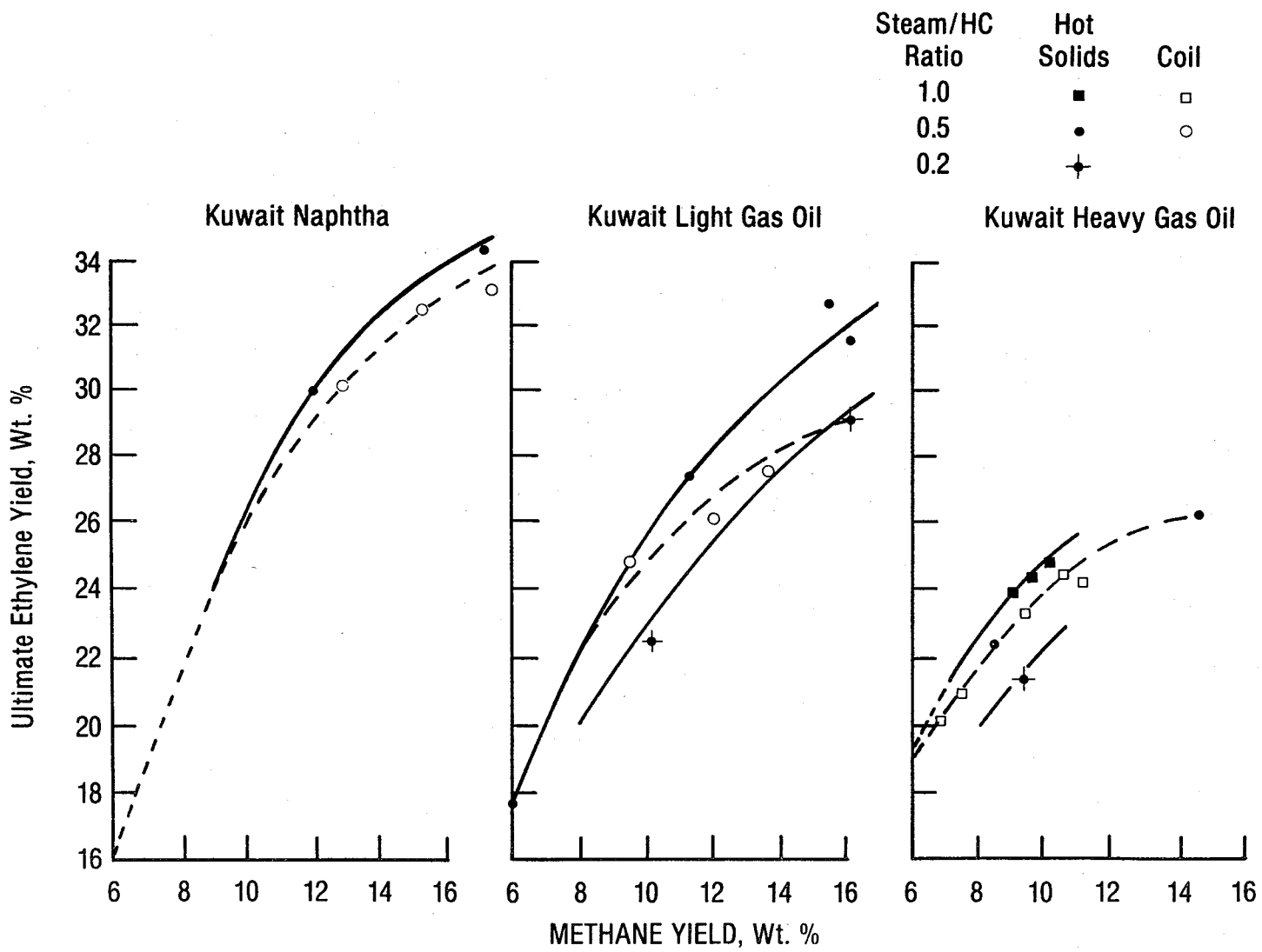
Figure 3:
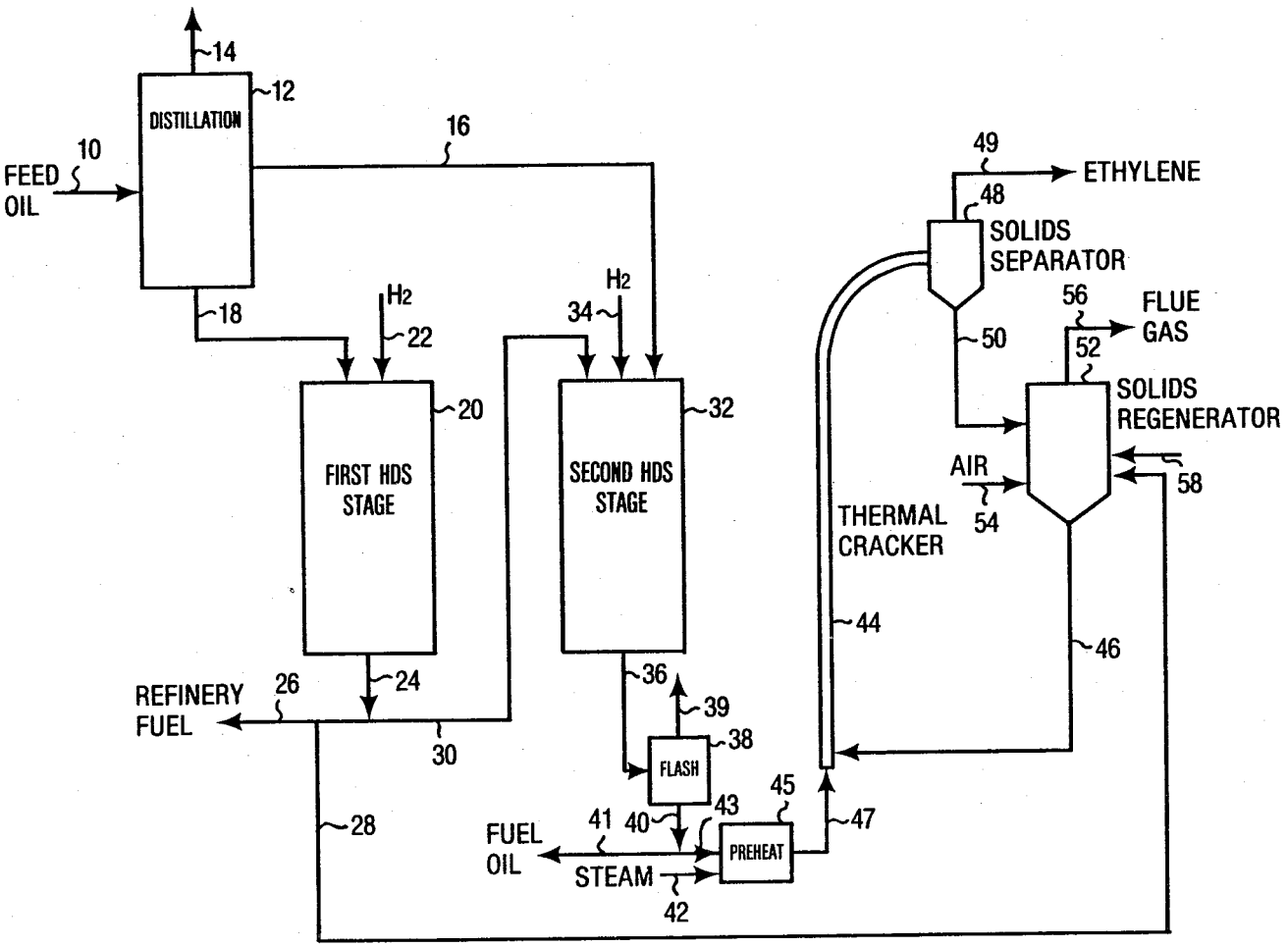
Figure 4:
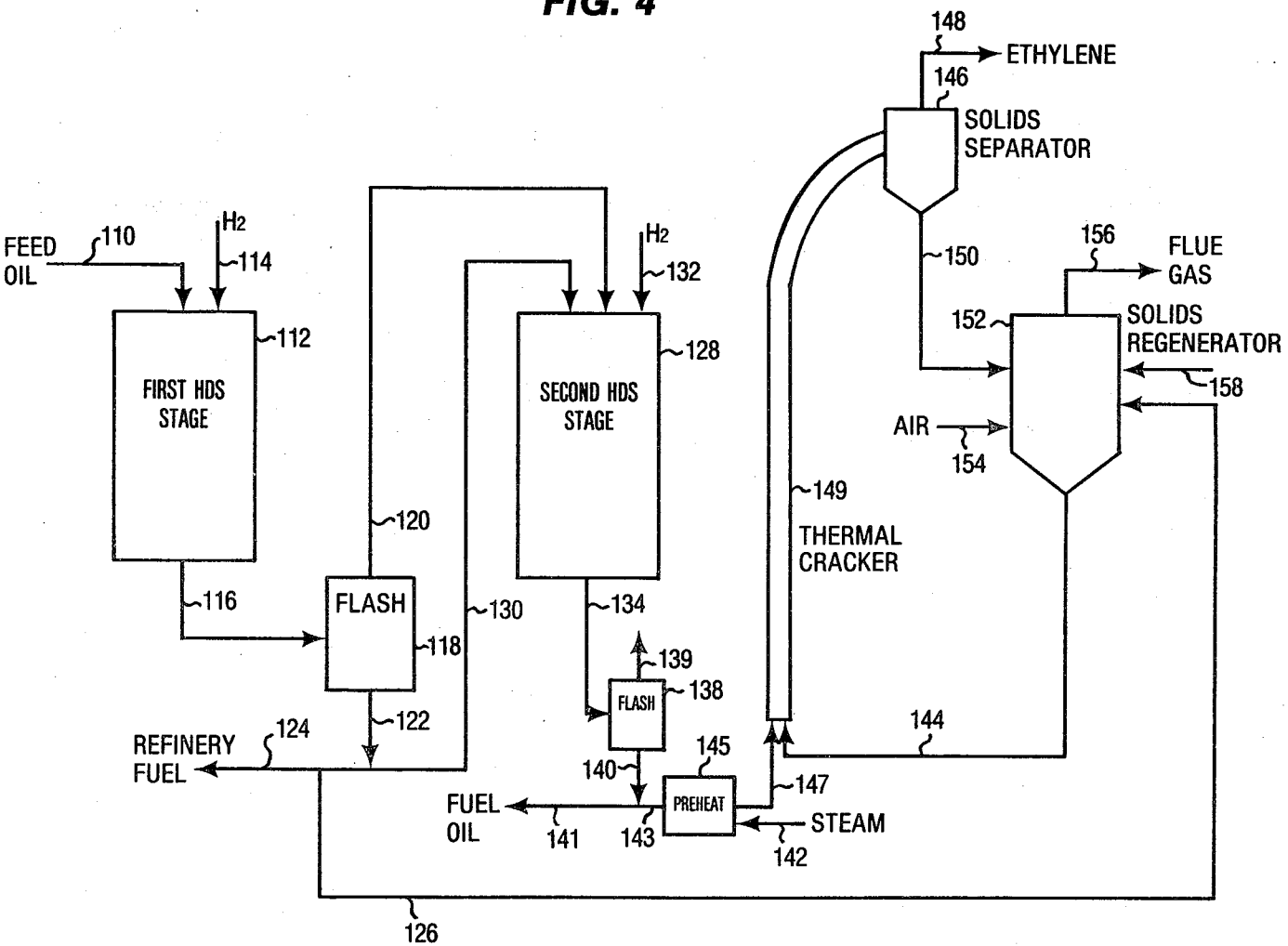

FIG. 1 contains graphs illustrating the component distribution in a residual oil hydrodesulfurization process, FIG. 2 contains graphs illustrating ethylene yields in thermal cracking processes, FIG. 3 shows one process scheme for performing the process of this invention, and FIG. 4 shows another process scheme for performing the process of this invention.

The decrease in hydrodesulfurization duty resulting from an increase in the aliquot ratio of distillate to residue components in the stream being treated is illustrated by the data of Table 1. Table 1 shows the volume percent of various boiling range fractions and the sulfur content of each fraction in a hydrodesulfurization effluent stream containing 0.15 weight percent sulfur obtained by hydrodesulfurization of a 650° F.+(343° C.+) Kuwait residual oil containing 4 weight percent sulfur.

TABLE I

| TBP FRACTION | VOL. % OF TOTAL YIELD | WT. % SULFUR IN FRACTION | % OF TOTAL SULFUR IN PRODUCT |
|---|---|---|---|
| IBP-375° F. (IBP-191° C.) | 1.62 | 0.04 | 0.38 |
| 375°-650° F. (191°-343° C.) | 13.71 | 0.04 | 3.50 |
| 650°-1065° F. (343°-574° C.) | 68.11 | 0.09 | 40.84 |
| 1,065° F. + (574° C. +) | 16.56 | 0.47 | 55.28 |

Table 1 shows that more than half of the total sulfur in the product is contained in the highest boiling 16.56 volume percent fraction of the total yield, which is the 1065° F.+(574° C.+) fraction. Therefore, if half of the 1065° F.+(574° C.+) product fraction could be utilized as refinery fuel, removal of this segment would constitute removal of only about 8 volume percent of the stream but would accomplish removal of about 28 weight percent of the total sulfur in the stream. It is seen that removal of a relatively small volumetric portion of the total stream, when the removed portion is a concentrated residue fraction, substantially diminishes the sulfur concentration in a remaining non-aliquot distillate-residue stream. This method thereby greatly reduces the depth of hydrodesulfurization required to produce an ultimate product having a low sulfur level. In this manner, a product having a low sulfur level can be produced with a relatively high hydrogen efficiency.

The data of Table 1 indicate that the most refractory sulfur in a residual oil is concentrated in the highest boiling fraction, which is the asphaltene-containing fraction. Asphaltenes are non-distillable. However, some of the non-distillable asphaltenes in the feed oil are upgraded to distillate material via hydrodesulfurization in the first stage, leaving the most refractory asphaltenes in the first stage effluent. This is illustrated by FIG. 1, herein, which was also presented in U.S. Pat. No. 3,761,399, and which shows the proportions of aromatics, saturates, resins and asphaltenes in a 650° F.+(343° C.+) residual oil as the oil experiences progressive catalytic hydrodesulfurization. The resins and asphaltenes comprise the residue of a propane extraction of the oil. Resins and asphaltenes are subsequently separable by a pentane extraction since resins are soluble in pentane while asphaltenes are not. As shown in FIG. 1, the resin and asphaltene content of the oil steadily decreases with increasing hydrodesulfurization. This decrease is due to the severing of carbon-sulfur bonds, thereby breaking off molecular fragments. The accumulation of these molecular fragments is reflected in FIG. 1 by the indicated build-up of lower molecular weight saturates and aromatics. When the desulfurization level reaches about 75 percent, the resin and asphaltene content of the oil becomes stable, indicating little additional severing of molecular fragments therein. At the same time, the total aromatics and saturates content also tends to stabilize, with any increase in saturates level being accompanied by a decrease in aromatics level. This indicates that after about 75 percent desulfurization the process tends to consume hydrogen by hydrogenation of aromatics, which represents a fruitless consumption of hydrogen.

It has been observed in conventional residual oil hydrodesulfurization processes which produce a very low sulfur residual oil product, requiring more than about 90 or 95 weight percent desulfurization, the unconverted asphaltenic material in the product becomes highly incompatible with the lower boiling oils and tends to settle out of solution. This incompatibility may arise because the hydrogen consumed during deep desulfurization is selectively acquired by the lower boiling oils, as indicated by the increase in saturates level in FIG. 1, while refractory asphaltenes are impervious to hydrogenation, thereby inducing a widened differential in the hydrogen to carbon ratios of the unconverted asphaltenes and the hydrogenated oils. The removal of a portion of a concentrated stream of asphaltenes from the process reduces the level of hydrogenation required to produce a low sulfur product so that the stability of the refractory asphaltenes remaining in the hydrodesulfurized oil tends to be improved.

FIG. 1 shows that a substantial portion of the feed asphaltenes (the general term "asphaltenes" as used herein includes both asphaltenes and resins, since both are non-distillable materials) can be converted to saturates and aromatics in an upstream hydrodesulfurization stage. The demonstration in FIG. 1 that a substantial portion of the feed asphaltenes can be converted in an upstream hydrodesulfurization stage is the reason that a portion of the asphaltenes is not removed directly from the feed oil in the hydrodesulfurization operation. By removing asphaltenes from an upstream stage effluent stream rather than directly from the feed oil, the asphaltene removal is selective towards refractory asphaltenes. The demonstration in FIG. 1 that an attempt to convert the refractory asphaltenes is extremely difficult and results in a wasteful consumption of hydrogen, as evidenced by a conversion of aromatics to saturates, is the reason that a portion of the refractory asphaltenes is removed in advance of the downstream stage.

Data were also presented in U.S. Pat. No. 3,761,399 showing that in a non-desulfurized residual oil the sulfur concentration in the various fractions are relatively uniform and that it is in the course of the hydrodesulfurization operation that the highest sulfur concentration devolves to the high boiling refractory asphaltene fraction. Table 2 shows the progressive changes in sulfur concentration occuring in various fractions during two stage catalytic hydrodesulfurization of a reduced crude oil containing 4.09 weight percent sulfur. The 650° F.+(343° C.+) product of the first stage had a sulfur content of 1.09 weight percent while the corresponding second stage effluent oil contained 0.58 weight percent sulfur.

TABLE 2

| | Feed to first stage (4.09 wt. % sulfur) | | Feed to second stage (1.09 wt. % sulfur) | | Product from second stage (0.58 wt. % sulfur) | |
|---|---|---|---|---|---|---|
| | Fraction | Sulfur in Fraction | Fraction | Sulfur in Fraction | Fraction | Sulfur in Fraction |
| Percent by wt.: | | | | | | |
| Saturates | 17.98 | 3.42 | 22.24 | 0.80 | 22.34 | 0.49 |
| Aromatics | 55.45 | 5.04 | 60.45 | 1.12 | 61.91 | 0.56 |
| Resins | 16.73 | 5.59 | 13.76 | 2.37 | 12.72 | 1.56 |
| Asphaltenes | 9.84 | 6.99 | 3.55 | 4.95 | 3.03 | 3.13 |

Table 2 shows that the sulfur levels in the various fractions of the feed oil are relatively uniform. However, during passage of the feed oil through the first hydrodesulfurization stage the saturates and aromatics lose sulfur to the greatest extent, while the resins and asphaltenes lose sulfur to the least extent. The same occurs during second stage hydrodesulfurization.

Table 3 contains data from U.S. Pat. No. 3,761,399 which show the effect of catalytic hydrodesulfurization upon the boiling range of a residual oil. In the tests of Table 3, the reduced crude was hydrodesulfurized in three stages.

TABLE 3

| | Feedstock | Effluent from each of three desulfurization stages | | |
|---|---|---|---|---|
| Sulfur, percent by wt. | 5.43 | 4.77 | 1.41 | 0.83 |
| Boiling range, °F. | 566–1,400+ (207°–560° C.+) | 514–1,400+ (268°–560° C.+) | 509–1,400+ (265°–560° C.+) | 466–1,400+ (241°–560° C.+) |
| Desulfurization, percent | — | 12.2 | 74.0 | 85.0 |

The data of Table 3 show that while the first 74 percent of the sulfur in the oil was being removed, the IBP of the oil was reduced from 566° to 509° F. (297° to 265° C.), or 57° F. (32° C.), while the attempt to reduce the sulfur content only slightly further to achieve 85 percent desulfurization induced reduction of the IBP to 466° F. (241° C.), or an additional 43° F. (24° C.). These data show that the first 74 percent desulfurization has a relatively small effect upon boiling point reduction, while the removal of the more refractory sulfur has a greater effect upon boiling point reduction. It is a significant feature of the present invention that since desulfurization is achieved in part by a dilution effect in place of deep hydrodesulfurization, the process of the present invention can diminish even the small amount of boiling point reduction shown in the above table, thereby reducing hydrogen consumption. Any reduction in hydrocracking in the hydrodesulfurization operation is particularly significant in the present invention because the hydrodesulfurization effluent is subsequently thermally cracked in the absence of added hydrogen. Thereby, any boiling point reduction in the hydrodesulfurization operation incurs the expense of hydrogen consumption, whereas the same can be achieved in the subsequent cracking step without incurring the expense of hydrogen consumption.

The catalyst of the first stage of a multi-stage residual oil hydrodesulfurization system is not greatly deactivated by coking because relatively reactive asphaltenes are available for conversion in the first stage. In multistage residual oil hydrodesulfurization processes, most of the sulfur is removed in the first stage. For example, the first stage generally removes 60, 70, 75 or more weight percent of the sulfur content in the feed oil. However, the more refractory asphaltenes pass unconverted through the first stage and it is the sulfur in these refractory asphaltenes that conventionally must be removed in second or third hydrodesulfurization stages. Unfortunately, refractory asphaltenes are known coke formers and the removal of sulfur therefrom in a downstream stage is conducive to coke formation. Therefore, in conventional multistage hydrodesulfurization operations, while coke formation is not significant in the first stage, the second stage catalyst is generally deactivated by coke, and the deactivation of the second stage catalyst generally occurs more rapidly than the deactivation of the first stage catalyst. The coke problem in a second or third stage is the reason for the use of a specialized coke-resistant catalyst in downstream stages, such as the Group IV-B metal-promoted coke resistant second stage catalyst utilized in the process of U.S. Pat. No. 3,968,027.

The amount of coking in a second or subsequent hydrodesulfurization stage generally increases with the concentration of refractory asphaltenes in the oil stream flowing through those stages. Downstream hydrodesulfurization catalysts tend to induce coking via agglomeration and polymerization of refractory asphaltene molecules. These reactions occur because desulfurization catalysts are hydrogenation-dehydrogenation agents and since the asphaltenes in the downstream stages are refractory to hydrodesulfurization their residence time at the surface of the catalyst is extended, blocking access of hydrogen to the catalyst, and it is this inaccessibility of hydrogen which induces dehydrogenation and ultimately coking. Any increase in the concentration of refractory asphaltenes tends to increase the incidence of agglomeration and polymerization and, conversely, the amount of coking in the second stage is reduced via removal of a portion of the refractory asphaltenes between the stages and by dilution of the non-removed asphaltenes prior to their entry into the second stage. The removal of a segment of the concentrated asphaltene stream flowing from the first stage in accordance with this invention constitutes selective removal of the most refractory molecules in the system. Dilution of the non-removed asphaltenes with non-desulfurized or partially desulfurized distillate oil shifts the desulfurization duty of the catalyst in second and subsequent stages from the refractory heteroatom sulfur embedded within polycondensed aromatic rings of asphaltenic molecules to the more reactive thiophenic sulfur in distillate molecules.

The stream flowing through the downstream stage comprises a non-aliquot ratio of distillate to residual components since it contains most or all of the distillate components of the feed stream but has been deprived of a portion of the asphaltenic components. The diminished quantity of refractory asphaltenes entering the second stage will have the benefit of the dilution and viscosity reducing effect of most or all of the distillate portion of the feed oil. It was shown in U.S. Pat. No. 3,761,399 that the rate of hydrodesulfurization of a residual fraction can be improved by diluting the residual fraction with highly desulfurized gas oil, probably due to solubilizing of viscous, high molecular weight sulfur-containing molecules and improving their mass transfer in the system. That patent further showed that excessive dilution of a residual fraction with highly desulfurized gas oil can inhibit the rate of desulfurization of the residual fraction, probably due to excessive dispersal of the sulfur-containing molecules. However, the present hydrodesulfurization operation tends to circumvent the problem of a diminished rate of second stage residual oil desulfurization. The present operation permits a relaxation of dependence upon deep desulfurization of the residual fraction by practicing the interdependent operations of selective removal from the process of a concentrated stream of sulfur-refractory residual components and dilution of the non-removed residual components with the distillate portion of the feed oil, so that the oil flowing through the downstream stage comprises a non-aliquot mixture of residual and distillate components, as compared to the feed oil. In this manner, in a downstream stage the quantity of the most sulfur-refractory material in the feed oil is diminished concomitantly with an increase in the concentration of the most sulfur-reactive material in the feed, releasing the process from the burden of accomplishing a deep desulfurization of residual components in order to achieve a low sulfur product.

Since the refractory asphaltenes removed between the stages is the material which would have contributed most heavily to coking in the downstream stage, the total liquid yield of the process is enhanced by avoiding conversion of liquid material to coke. This advantageous yield effect provides a concomitant advantageous catalyst aging effect since diminution of coke formation in the downstream stage tends to extend the active life of the second stage catalyst.

The described hydrodesulfurization operations involve plural stage hydrodesulfurization of an asphaltene-containing residual oil in which at least two different streams of hydrodesulfurized residual oil are removed from the process with each removed stream having a different sulfur content and boiling range as it is separated from the process, without any product blending or product distillation step being required to accomplish these differences. One of the product residual oil streams has a narrow boiling range and a relatively high sulfur level while the other product residual oil stream has a wider boiling range and a relatively low sulfur level. The low sulfur residual oil stream comprises the feedstock for the thermal cracking operation. The relatively high sulfur level residual oil product can be employed as fuel for the solids regenerator of the thermal cracking operation. In addition to advantageously increasing the aliquot ratio of distillate to residual components, removal of the refinery fuel stream in the hydrodesulfurization operation avoids overtreating of that portion of the total stream, relative to its intended use, resulting in a significant savings in hydrogen, in extended hydrodesulfurization catalyst life and in increased liquid yield in the hydrodesulfurization operation. The increased liquid yield results from reduced conversion to coke.

The catalyst of all of the hydrodesulfurization stages comprises at least one Group VI metal and at least one Group VIII metal on a non-cracking support. Suitable Group VI and Group VIII metal combinations include cobalt-molybdenum, nickel-tungsten and nickel-molybdenum. A preferred combination is nickel-cobalt-molybdenum. The catalyst support comprises a highly porous, non-cracking supporting material. Alumina is the preferred supporting material, but other porous, non-cracking supports can be employed, such as silica-alumina and silica-magnesia.

The catalyst in any downstream hydrodesulfurization stage can be the same as or different from the catalyst employed in the first stage. For example, the proportions of catalytic metals can be the same or can be different. The composition of the downstream catalyst can be generally the same as the composition of the first stage catalyst except that it contains a promoting amount of a Group IV-B metal, such as titanium, zirconium or hafnium, preferably titanium. Promotion with a Group IV-B metal improves the resistance of the downstream catalyst to coking. However, removal of a portion of the refractory asphaltene stream in advance of the downstream stage as indicated diminishes the need for a coke-resistant downstream catalyst.

In the hydrodesulfurization operation, the oil is passed downwardly through a fixed bed of catalyst in each stage. Very little hydrocracking occurs in the hydrodesulfurization operation. In general, at least 40 or 50 weight percent of the total hydrodesulfurization product boils above the IBP of the hydrodesulfurization feed oil and, preferably, at least 70, 80 or 90 weight percent of the hydrodesulfurization product boils above the IBP of the hydrodesulfurization feed oil. The hydrodesulfurization temperature should be sufficiently low that not more than 30 percent, generally, and preferably not more than about 20, 15 or even 10 percent of the 650° F.+ (343° C.+) feed oil will be converted to material boiling below 650° F. (343° C.).

The hydrodesulfurization operation employs in each stage a hydrogen partial pressure of 500 to 5,000 pounds per square inch (35 to 350 kg/cm$^2$), generally, 1,000 to 3,000 pounds per square inch (70 to 210 kg/cm$^2$), preferably, and 1,500 to 3,000 pounds per square inch (105 to 175 kg/cm$^2$), most preferably. The gas circulation rate in each stage can be between 1,000 and 20,000 standard cubic feet per barrel (17.8 and 356 SCM/100 L), generally, or preferably about 2,000 to 10,000 standard cubic feet per barrel (35.6 to 178 SCM/100 L). The gas circulated preferably contains 85 percent, or more, of hydrogen. The mol ratio of hydrogen to oil in each stage can be between about 4:1 and 80:1. Reactor temperatures vary between about 600° and 900° F. (316° and 482° C.), generally, and between about 650° and 800° F. (343° and 427° C.), preferably. Reactor temperatures are increased in each stage during a catalyst cycle to compensate for activity loss due to aging. The liquid hourly space velocity in each reactor can be between about 0.1 and 10, generally, and between about 0.2 and 1 or 2, preferably.

The present process can be used for hydrodesulfurizing and thermally cracking asphaltene-containing oils other than petroleum oils, such as coal liquids and oils extracted from shale and tar sands. Asphaltenes have a relatively low hydrogen to carbon ratio and will generally contain most of the metallic components present in the total feed, such as nickel and vanadium.

In accordance with the present invention, the residual oil product of the final stage of the above-described hydrodesulfurization operations, either with or without further hydrodesulfurization in one or more additional hydrogenation stages, is employed as a feedstock for a thermal cracking process employing inert hot solids as a heat source for the production of ethylene and other products. It is shown below that when a hydrodesulfurization process as described above is combined with the described thermal cracking process, the processes function in a highly interdependent manner.

The interdependence between the described hydrodesulfurization process and a thermal cracking process employing inert hot solids as the heat source will become apparent by reference to the thermal cracking data shown in FIG. 2. FIG. 2 shows the ultimate ethylene yield, corresponding to methane yield, obtainable upon thermal cracking of progressively heavier feed stocks, such as naphtha, hydrodesulfurized light gas oil and hydrodesulfurized heavy gas oil feedstocks. FIG. 2 shows the ethylene yield obtainable when these feedstocks are cracked in the presence of entrained hot solids as a heat source at various steam to hydrocarbon ratios and also shows the ethylene yield obtainable when the same feed stocks are cracked without hot solids in a coil passing through a furnace at various steam to hydrocarbon ratios. In the thermal cracking tests employing entrained hot solids, heat for the cracking operation is obtained by burning coke deposited on the hot solids and other fuel in an external regenerator. FIG. 2 shows that in all cracking tests the ratio of steam diluent to hydrocarbon feed has a great effect upon ethylene yield, with an increase in said ratio tending to increase ethylene yield. In addition, the data of FIG. 2 show that with all three feedstocks at a given steam to hydrocarbon ratio the ethylene yield is greater when cracking occurs in the presence of inert hot solids than in a coil.

An important showing of FIG. 2 is that in the case of both coil cracking and hot solids cracking, as the feedstock becomes progressively higher boiling, ethylene yields decline and steam requirements increase. Therefore, because the above-described hydrodesulfurization operations increase the proportion of low boiling components in a residual hydrodesulfurized stream, they provide a thermal cracking feedstock relatively enriched in hydrocarbons which can be converted in high yield to ethylene with relatively low steam requirements. The residual components removed in the above-described hydrodesulfurization operations are the hydrocarbon components which upon thermal cracking result in a low ethylene yield and require a very high steam to hydrocarbon ratio. In summation, the distillate-enriched and asphaltene-impoverished hydrodesulfurization effluent of the above-described hydrodesulfurization operations can be thermally cracked in accordance with the present invention to provide a higher ethylene yield with a greater steam economy than the effluent of a similar hydrodesulfurization process except that an asphaltene-rich stream is not removed between hydrodesulfurization stages.

Further interdependence between the hydrodesulfurization and thermal cracking operations of this invention is achieved by employing the asphaltene-rich stream removed between hydrodesulfurization stages as a fuel in the regenerator utilized to heat the solids for recycling. Although coke is deposited upon these solids during the thermal cracking operation, the amount is generally insufficient to supply adequate heat upon combustion to satisfy the heat requirements of the thermal cracking step. Use of the asphaltene-rich stream as supplemental fuel releases the cracking process from the requirement of consuming its own more valuable liquid product as supplemental fuel. The liquid product of the cracking process is known as black oil. Black oil is highly aromatic and constitutes a valuable feedstock for the production of carbon black and for the manufacture of needle coke, which is used in the manufacture of electrodes. If the sulfur content of the asphaltene-rich oil removed from the hydrodesulfurization process is so high that its combustion in the solids regenerator results in excessive sulfur dioxide emissions in the regenerator flue gas, low sulfur, low quality oil streams commonly available in a refinery, such as decanted oil and cycle oil, can be blended with the hydrodesulfurized oil to provide a blended fuel having a sufficiently low sulfur content to meet regenerator flue gas sulfur oxide specifications.

In the thermal cracker operation, the average riser temperature is between about 1,300° and 2,500° F. (704° and 1,371° C.), generally, between about 1,400° and 2,000° F. (760° and 1,093° C.), preferably, and between about 1,430° and 1,830° F. (777° and 1,010° C.), most preferably, The hydrodesulfurized thermal cracker feed oil can be preheated in advance of the riser, if required, or feed oil preheating can be omitted. If the oil is preheated, any preheating temperature up to the temperature of the oil vaporization or coking can be employed. Immediately upon leaving the cracking riser, the product stream should be quenched to a temperature below about 1,300° F. (704° C.). Cold solids, water, steam and cycle oils are examples of suitable quench materials. Any quench temperature below 1,300° F. (704° C.), such as between about 890° and 1,300° F. (477° and 704° C.), is suitable.

The pressure employed in the riser should be adequate to force the riser effluent stream through downstream product separation equipment. The pressure will be between about 3 and 100 psig (0.2 and 7 kg/cm$^2$), generally, and between about 5 and 50 psig (0.35 and 3.5 kg/cm$^2$), preferably. Most commonly, a pressure above about 15 psig (10.5 kg/cm$^2$) will be required. The riser residence time can be between about 0.05 and 2 seconds, generally, or between about 0.05 and 0.5 seconds, preferably. Higher residence times induce either undesired olefin polymerization reactions or undesired cracking of light or heavy products. The weight ratio of solids to feed oil can be between about 4:1 and 100:1, generally, and between about 10:1 and 30:1, preferably. The hot solids can be supplied to the riser at any temperature which is at least 50° F. (27.8° C.) above the riser outlet temperature, up to a maximum temperature of about 3,500° F. (1,371° C.). The temperature of the solids supplied to the riser will be about the same as the temperature within the coker burner. Only one stream of solids at the desired temperature is generally required for the cracking operation.

Any catalytically inert material or mixture can serve as a solid heat carrier. Suitable materials include non-catalytic alumina, alundum, carborundum, coke, deactivated catalyst, etc. Neither the particle size nor the surface area of the inert solids is critical. Any size capable of passing through the riser in entrained flow with the reactant oil and diluent gas with little or no slippage can be employed.

In the solids regenerator, the coke-laden solids are subjected to burning in the presence of air at a temperature above 1,700° F. (927° C.). The burner flue gases can be passed to an energy recovery unit, such as a steam generator or a turbo-expander. The flue gases should contain less than about 50 to 500 ppm by volume of sulfur oxides in order to be environmentally acceptable. Otherwise, a stack gas scrubber will be required. Because of the elevated combustion temperatures, the concentration of carbon monoxide will be low even with little excess air.

The cracking severity in the riser should correspond to a methane yield of between about 6 and 16 weight percent. The steam to hydrocarbon weight ratio in the cracking riser should be at least 0.2 and can be up to 1 or 1.5, or more. In addition to ethylene, the cracking operation produces hydrogen, methane, ethane, propylene, and 1,3-butadiene. Liquid products are produced by combination of intermediate olefinic and aromatic material in the reactor and can comprise 40 or 50 weight percent or more of the total product. Recovered liquid products include benzene, mixtures of benzene, toluene and xylenes (BTX), gasoline boiling range liquids and light and heavy gas oils.

A process scheme for performing the present invention is presented in FIG. 3. As shown in FIG. 3, feed crude oil or topped crude oil in line 10 is passed to distillation column 12 from which a light oil which can comprise naphtha is removed through line 14, a light gas oil and/or heavy gas oil fraction is removed through line 16 and a residual oil fraction is removed through line 18. The distillate oil in line 16 can have a boiling range between 350° and 650° F. (177° and 343° C.), between 350° and 800° F. (177° and 427° C.), between 650° and 800° F. (343° and 427° C.), or it can have any other suitable boiling range. The residual oil fraction in line 18 can be a 650° F. + (343° C.+) oil, an 800° F.+ (427° C.+) oil, or it can have any other suitable IBP. The residual oil in line 18 is passed to first catalytic hydrodesulfurization stage 20 together with hydrogen entering through line 22. First stage effluent is removed through line 24. A portion of the first stage effluent is withdrawn from the process through line 26, and can be utilized as refinery fuel. Some or all of the refinery fuel can be passed through line 28 to solids regenerator 52, to be used as explained below. If desired, the refinery fuel can be blended with a low sulfur, low quality refinery stream, such as decanted oil or cycle oil.

The remainder of the first stage effluent from line 24 is passed through line 30 to second catalytic hydrodesulfurization stage 32 together with hydrogen in line 34 and distillate oil in line 16. The distillate oil in line 16 by-passes first hydrodesulfurization stage 20 and is passed directly to second hydrodesulfurization stage 32. Second stage effluent passes through line 36 to flash chamber 38 from which hydrogen and other gases are removed through line 39 and liquid is removed through line 40. A portion of the liquid in line 40 can be removed from the process through line 41 for use as a commercial fuel oil while the remainder of the second stage effluent is passed through line 43 to a preheater 45 wherein it is directly admixed with steam entering through line 42 and preheated by means of a burner. Preheated oil and steam enter the bottom of cracking riser 44 through line 47. Regenerated inert solids in line 46 are also passed to the bottom of riser 44.

In thermal riser 44 the hydrodesulfurized oil is converted to ethylene and other gases, as well as to an aromatic heavy black oil and some coke. The heavy black oil is a valuable feedstock for the production of needle coke and carbon black. In conventional processes, this heavy black oil must be consumed as a fuel in solids regenerator 52, or in a steam heating or power generation system, but in accordance with the present process this black oil is made available for its more valuable uses because of the availability of the relatively lower value refinery fuel in line 28 for use as regenerator fuel. The refinery fuel in line 28 is not a highly suitable feedstock for the production of needle coke or carbon black. A small amount of the black oil will contain solids and this portion should be passed to the regenerator as fuel in order to recover the solids.

The effluent from thermal cracker 44 is passed to solids separator 48 from which ethylene and other gases, as well as normally liquid products, including black oil, are removed through line 49, while coke-laden inert solids are removed through line 50. The coke-laden solids are passed to solids regenerator 52 wherein surface coke is burned by means of air entering through line 54 to produce flue gas which is removed through line 56. Supplementary fuel is supplied to burner 52 in the form of refinery fuel entering through line 28 with or without other refinery streams, including decanted oil and cycle oil, entering through line 58. The refinery fuel may have been desulfurized to an extent that sulfur oxide emission requirements in flue gas stream 56 are satisfied. If not, blending with a sufficient quantity of lower sulfur decanted oil or cycle oil streams is required.

The thermal cracker feed oil flowing through line 47 has been enriched in distillate components by means of removal of a concentrated stream of residual components as refinery fuel through lines 26 and 28, followed by the direct addition of feed distillate oil in line 16 to the remaining residue being charged to second hydrodesulfurization stage 32. It was shown above that both ethylene yield and steam economy in a thermal cracking process can be enhanced by enrichment of a thermal cracking feedstock with lowboiling materials and by removal of high boiling materials. Therefore, the hydrodesulfurization process scheme shown in FIG. 3 is highly interdependent with respect to the thermal cracking operation.

Another process scheme of this invention is shown in FIG. 4. As shown in FIG. 4, feed oil in line 110, which can be a 375° F.+ (191° C.+) residual oil or which can have any other suitable IBP, is passed to first catalytic hydrodesulfurization stage 112 together with hydrogen in line 114. First hydrodesulfurization stage effluent in line 116 is passed to flash chamber 118 from which a distillate oil, such as a 375° to 650° F. (191° to 343° C.) oil, is removed overhead through line 120 while a residual oil is removed through line 122. A portion of the residual oil from line 122 is removed from the process as refinery fuel through line 124, while another portion can be passed through line 126 to solids regenerator 152, to be used as explained below. The remainder of the residual oil in line 122 is passed to second catalytic hydrodesulfurization stage 128 through line 130.

Residual oil in line 130, distillate oil in line 120 and hydrogen in line 132 are all passed through second catalytic hydrodesulfurization stage 128 from which an effluent stream is removed through line 134. The stream in line 134 is passed to flash chamber 138 from which a gaseous stream comprising hydrogen and other gases is removed through line 139 and liquid is removed through line 140. A portion of the liquid in line 140 is removed from the process as commercial fuel oil through line 141, while the remainder is passed through line 143 to preheater 145 wherein it is directly mixed with steam entering through line 142 and heated by means of a burner. Hot oil and steam pass through line 147 to the bottom of thermal riser 149. Hot inert solids in line 144 are also passed to the bottom of thermal riser 149. The effluent from riser 149 passes through solids separator 146, from which ethylene and other gases, as well as normally liquid hydrocarbonaceous products, including black oil, are removed through line 148. A small amount of the black oil will contain solids and this portion should be passed to the regenerator as fuel in order to recover the solids. Coke-laden solids are removed from the solids separator 146 through line 150 and passed to solids regenerator 152.

In regenerator 152, coke is burned from the inert solids by means of air entering through line 154 to produce a flue gas which is removed through line 156. Refinery fuel in line 126 and/or other fuel, such as decanted oil or cycle oil, entering through line 158 can be passed to regenerator 152. Hot, inert solids which have a reduced carbon content are removed from regenerator 152 through line 144 for passage to thermal riser 149.

The thermal cracker feed oil in line 147 has been enriched in distillate materials by means of removal of a concentrated stream of residual components in lines 124 and 126 followed by addition of the distillate stream in line 120 to the remaining residual materials. Since it was shown above that the ethylene yield and steam economy in thermal cracker 149 is enhanced by enrichment of the cracker feed oil with low boiling components and by removal of high boiling components, the hydrodesulfurization scheme shown in FIG. 4 is highly interdependent with respect to the thermal cracking operation.

We claim:

1. A combination process including hydrodesulfurization of an aromatics- and asphaltene-containing feed oil to produce at least two hydrodesulfurized residual oil streams having different respective asphaltene and sulfur contents, said process employing upstream and downstream hydrodesulfurization stages containing hydrodesulfurization catalyst comprising Group VI and Group VIII metal on a non-cracking support at a temperature between 600° and 900° F. and a hydrogen pressure between 500 and 5,000 psi, followed by a thermal cracking step utilizing inert hot solids as a heat source, said process comprising fractionating said feed oil into an asphaltene-containing residual oil and a distillate oil, passing said residual oil and hydrogen through said upstream hydrodesulfurization stage and recovering an upstream stage effluent stream containing refractory sulfur asphaltenes, splitting said upstream stage effluent stream into a first effluent portion comprising between about 10 and 75 weight percent of the normally liquid material in said upstream stage effluent stream and a second effluent portion, removing said first effluent portion from the hydrodesulfurization operation to selectively remove refractory sulfur asphaltenes from said process and to increase the concentration of more sulfurreactive material in said downstream stage, passing said second effluent portion and said distillate oil and hydrogen through said downstream hydrodesulfurization stage, said distillate oil bypassing said upstream hydrodesulfurization stage, recovering a downstream stage effluent stream, said downstream stage effluent stream containing aromatics and having a sulfur concentration which is at least 75 percent lower than the sulfur concentration of said feed oil, the removal of said first effluent portion allowing the sulfur concentration in said downstream stage effluent stream to be achieved with a relatively high aromatics concentration as compared to the aromatics concentration when achieving the same sulfur concentration by hydrodesulfurization without selective removal of refractory sulfur asphaltenes, passing said downstream stage effluent stream and regenerated inert hot solids through a thermal cracking riser at a temperature between 1,300° and 2,500° F. for a residence time between 0.05 and 2 seconds for conversion to a thermally cracked effluent stream including ethylene, separating coke-containing solids from said thermally cracked effluent stream, passing said coke-containing solids to a regeneration zone for combustion of coke therefrom, and recycling hot solids from said regeneration zone to said thermal cracking riser.

2. The process of claim 1 wherein said downstream stage effluent stream is passed through an additional hydrodesulfurization stage before being passed to said thermal cracking riser.

3. The process of claim 1 wherein said first effluent portion is passed to said regeneration zone for use as fuel therein.

4. The process of claim 1 wherein said first effluent portion comprises between about 30 and 50 weight percent of the normally liquid material in said upstream stage effluent stream.

5. The process of claim 1 wherein said first effluent portion comprises between about 20 and 65 weight percent of the normally liquid material in said upstream stage effluent stream.

6. The process of claim 1 wherein in the hydrodesulfurization operation not more than 10 percent of the feed oil boiling above 650° F. is converted to material boiling below 650° F.

7. The process of claim 1 wherein in the hydrodesulfurization operation not more than 30 percent of the feed oil boiling above 650° F. is converted to material boiling below 650° F.

8. The process of claim 1 wherein the downstream hydrodesulfurization stage catalyst contains a promoting amount of Group IV-B metal.

9. A combination process including hydrodesulfurization of an aromatics- and asphaltene-containing feed oil to produce at least two hydrodesulfurized residual oil streams having different respective asphaltene and sulfur contents, said process employing upstream and downstream hydrodesulfurization stages containing hydrodesulfurization catalyst comprising Group VI and Group VIII metal on a non-cracking support at a temperature between 600° and 900° F. and a hydrogen pressure between 500 and 5,000 psi, followed by a thermal cracking step utilizing inert hot solids as a heat source, said process comprising passing said feed oil and hydrogen through said upstream hydrodesulfurization stage and recovering an upstream stage effluent stream containing refractory sulfur asphaltenes, passing said upstream stage effluent stream through a flash zone to separate a flash distillate stream from a flash residue stream, splitting said flash residue stream into a first flash residue portion comprising between about 10 and 75 weight percent of said flash residue stream and a second flash residue portion, removing said first flash residue portion from the hydrodesulfurization operation to selectively remove refractory sulfur asphaltenes from said process and to increase the concentration of more sulfur-reactive material in said downstream stage, passing said second flash residue portion and said flash distillate stream and hydrogen to said downstream stage, recovering a downstream stage effluent stream, said downstream stage effluent stream containing aromatics and having a sulfur concentration which is at least 75 percent lower than the sulfur concentration of said feed oil, the removal of said first flash residue portion allowing the sulfur concentration in said downstream stage effluent stream to be achieved with a relatively high aromatics concentration as compared to the aromatics concentration when achieving the same sulfur concentration by hydrodesulfurization without selective removal of refractory sulfur asphaltenes, passing said downstream stage effluent stream and regenerated inert hot solids through a thermal cracking riser at a temperature between 1,300° and 2,500° F. and a residence time between 0.05 and 2 seconds for conversion to a thermally cracked effluent stream including ethylene, separating coke-containing solids from said thermally cracked effluent stream, passing said coke-laden solids to a regeneration zone for combustion of coke therefrom, and recycling hot solids from said regeneration zone to said thermal cracking riser.

10. The process of claim 9 wherein said downstream stage effluent stream is passed through an additional hydrodesulfurization stage before being passed to said thermal cracking riser.

11. The process of claim 9 wherein said first flash residue portion is passed to said regeneration zone for use a fuel therein.

12. The process of claim 9 wherein said first flash residue portion comprises between about 30 and 50 weight percent of said flash residue stream.

13. The process of claim 9 wherein said first flash residue portion comprises between about 20 and 65 weight percent of said flash residue stream.

14. The process of claim 9 wherein in the hydrodesulfurization operation not more than 10 percent of the feed oil boiling above 650° F. is converted to material boiling below 650° F.

15. The process of claim 9 wherein in the hydrodesulfurization operation not more than 30 percent of the feed oil boiling above 650° F. is converted to material boiling below 650° F.

16. The process of claim 9 wherein the downstream hydrodesulfurization stage catalyst contains a promoting amount of Group IV-B metal.

* * * * *